US005175940A

United States Patent [19]

Naill et al.

[11] Patent Number: 5,175,940

[45] Date of Patent: Jan. 5, 1993

[54] BLIND HOLE FINDER

[76] Inventors: David A. Naill, 25 Jefferson Dr., Abbottstown, Pa. 17301-9756; George Spector, 233 Broadway, Rm. 3815, New York, N.Y. 10007

[21] Appl. No.: 747,279

[22] Filed: Aug. 19, 1991

[51] Int. Cl.[5] ..... G01B 5/14

[52] U.S. Cl. ..... 33/666; 33/574

[58] Field of Search ..... 33/666, 677, 574

[56] References Cited

U.S. PATENT DOCUMENTS 1,623,816 4/1927 Spencer ..... 33/574 X
1,732,017 10/1929 Jenkins ..... 33/42 X
2,570,328 10/1951 Dritz ..... 33/2 R X
2,975,520 3/1961 Ericson et al. ..... 33/41.1
4,144,651 3/1979 Baun ..... 33/42 X

*Primary Examiner*—Harry N. Haroian

[57] ABSTRACT

A blind hole finder tool is provided which consists of a C-shaped spring member, with a pair of elongated arms, each extending from one side of the C-shaped spring member. A mechanism is on a distal end of the first arm for engaging with an original rivet hole in a top rail of a trailer. Another mechanism is on a distal end of the second arm, being in alignment with the engaging mechanism, for marking the hole location in new roof material after the new roof material is placed upon the top rail, so that the new roof material can be secured to the top rail at the original rivet hole.

3 Claims, 1 Drawing Sheet

BLIND HOLE FINDER

BACKGROUND OF THE INVENTION

The instant invention relates generally to devices for locating apertures and more specifically it relates to a blind hole finder tool which provides a mechanism to mark original rivet holes in top rails after new roof material is placed thereon.

There are available various conventional devices for locating apertures which do not provide the novel improvements of the invention herein disclosed.

SUMMARY OF THE INVENTION

A primary object of the present invention is to provide a blind hole finder tool that will overcome the shortcomings of the prior art devices.

Another object is to provide a blind hole finder tool that includes a mechanism to mark and punch the original rivet holes in top rails on new roof material after the new roof material is placed thereon, so that the new roof material can be secured to the top rails.

An additional object is to provide a blind hole finder tool in which the mechanism to mark the original rivet holes that is adjustable for various thicknesses and lengths of the top rails and the new roof material.

A further object is to provide a blind hole finder tool that is simple and easy to use.

A still further object is to provide a blind hole finder tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
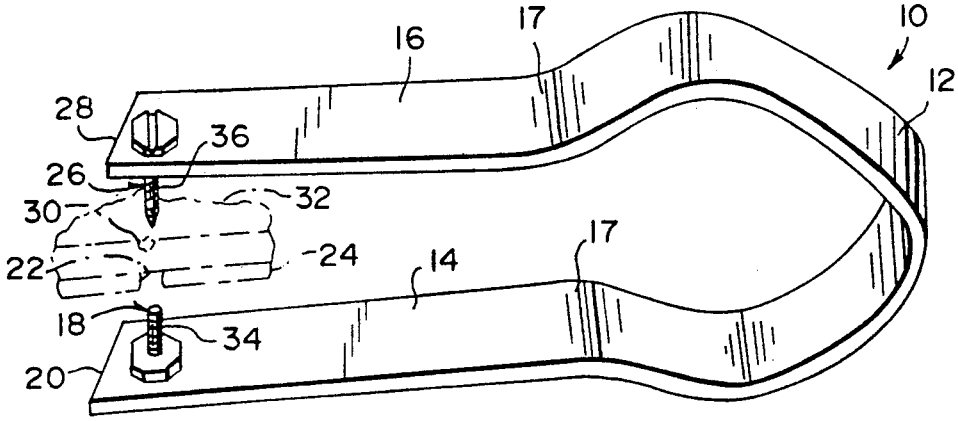
FIG. 1 is a perspective view of the instant invention.

Turning now descriptively to the drawings, in which similar reference characters denote similar elements throughout the several views, the Figures illustrate a blind hole finder tool 10 which consists of a C-shaped spring member 12, with a pair of elongated arms 14 and 16, each extending from one side 17 of the C-shaped spring member 12. A mechanism 18 is on a distal end 20 of the first arm 14 for engaging with an original rivet hole 22 in a top rail 24 of a trailer. Another mechanism 26 is on a distal end 28 of the second arm 16, being in alignment with the engaging mechanism 18, for marking the hole location 30 in new roof material 32 after the new roof material 32 is placed upon the top rail 24, so that the new roof material 32 can be secured to the top rail 24 at the original rivet hole 22.

The engaging mechanism 18 is a flat dowel end 34 extending at a right angle to the plane of the first arm 14. The marking mechanism 26 is a punch pin 36 extending at a right angle to the plane of the second arm 16.

Figure 2:
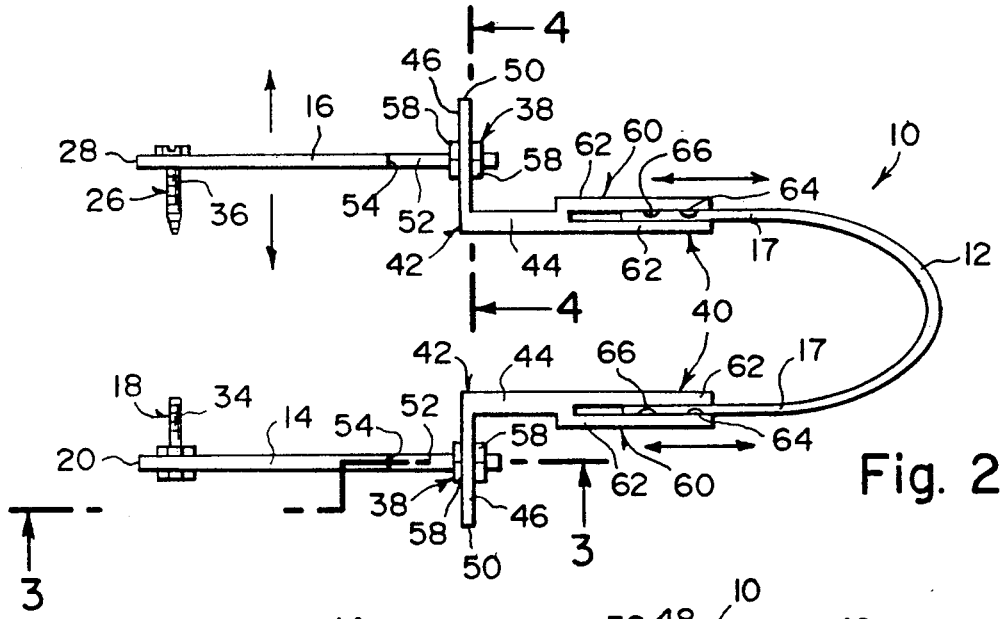
FIG. 2 is a side view of a modification in which the arms are adjustable for various thicknesses and lengths of the top rails and the new roof material.
Figure 3:
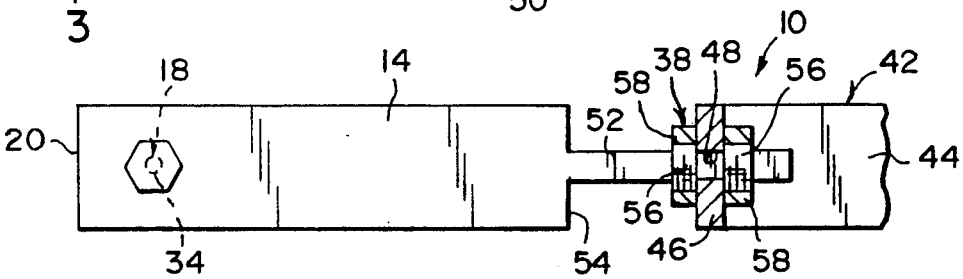
FIG. 3 is a cross sectional view taken along line 3—3 in FIG. 2, showing one of the adjustable arms in greater detail.
Figure 4:
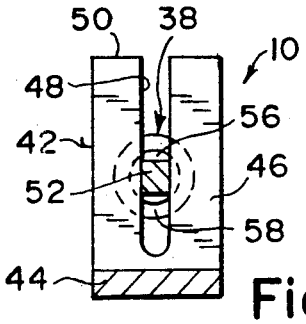
FIG. 4 is a cross sectional view taken along line 4—4 in FIG. 2, showing the slotted flange in greater detail.

The blind hole finder tool 10, as shown in FIGS. 2 to 4, further includes a mechanism 38 for adjusting the latitudinal position of the arms 14 and 16. A mechanism 40 is also provided for adjusting the longitudinal position of the arms 14 and 16 to compensate for various thicknesses and lengths of the top rial 24 and the new roof material 32. Each latitudinal position mechanism 38 includes an L-shaped member 42 having a first flange 44 at the one side of the C-shaped spring member 12 and a second flange 46 extending outwardly at the arm 14 or 16. The second flange 46 has a slot 48 extending from its distal end 50 thereof. The arm 14 or 16 has a square shaped shaft 52 extending from its back end 54 thereof with a pair of spaced apart circular threaded portions 56 formed thereon, so that the shaft 52 can fit into the slot 48 between the circular threaded portions 56. A pair of nuts 58 are threaded onto the circular threaded portions 56 so as to retain the shaft 52 to the second flange 46.

Each longitudinal position mechanism 40 includes a longitudinal slide track 60 being two prongs 62 formed in the first flange 44 of the L-shaped member 42 having an inwardly facing detent 64 in one of the prongs 62. The one side 17 of the C-shaped spring member 12 has a pair of spaced apart indents 66 so that the one side 17 of the C-shaped spring member 12 can slide within the two prong 62 and be retained at a predetermined position by the detent 64 in engagement with one of the indents 66.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A blind hole finder tool which comprises:

a) a C-shaped spring member;

b) a pair of elongated arms, each extending from one side of said C-shaped spring member;

c) means on a distal end of said first arm for engaging with an original rivet hole in a top rail of a trailer;

d) means on a distal end of said second arm, being in alignment with said engaging means, for marking the hole location in new roof material after the new roof material is placed upon the top rail, so that the new roof material can be secured to the top rail at the original rivet hole; wherein said engaging means is a flow dowel end extending at a right angle to the plane of said first arm; wherein said marking means is a punch pin extending at a right angle to the plane of said second arm; further including:

e) means for adjusting the latitudinal position of said arms; and f) means for adjusting the longitudinal position of said arms to compensate for various thicknesses and lengths of the top rail and the new roof material.

2. A blind hole finder tool as recited in claim 1, wherein each said latitudinal position means includes:

a) an L-shaped member having a first flange at the one side of said C-shaped member and a second flange extending outwardly at said arm;

b) said second flange having a slot extending from its distal end thereof;

c) said arm having as square shaped shaft extending from its back end thereof with a pair of spaced apart circular thread portions formed thereon so that said shaft can fit into the slot between the circular threaded portions; and d) a pair of nuts threaded onto the circular threaded portions so as to retain said shaft to said second flange.

3. A blind hole finder tool as recited in claim 2, wherein each said longitudinal position means includes:

a) a slide track being two prongs formed in said first flange of said L-shaped member having an inwardly facing detent in one of said prongs; and b) said one side of said C-shaped spring member having a pair of spaced apart indents so that said one side of said C-shaped spring member can slide within said two-prongs and be retained at a predetermined position by said detent in engagement with one of said indents.

* * * * *